US007416036B2

(12) United States Patent
Forstner et al.

(10) Patent No.: US 7,416,036 B2
(45) Date of Patent: Aug. 26, 2008

(54) LATCHABLE REAMING BIT

(75) Inventors: Ingo Forstner, Ahnsbeck (DE); Angela Durkin, Hundvaag (NO); Troy Miller, Bellville, TX (US); Morten Myhre, Tananger (NO)

(73) Assignee: Baker Hughes Incorporated, Houston, TX (US)

( * ) Notice: Subject to any disclaimer, the term of this patent is extended or adjusted under 35 U.S.C. 154(b) by 253 days.

(21) Appl. No.: 11/404,337

(22) Filed: Apr. 14, 2006

(65) Prior Publication Data

US 2007/0034412 A1 Feb. 15, 2007

Related U.S. Application Data

(60) Provisional application No. 60/707,654, filed on Aug. 12, 2005.

(51) Int. Cl.
*E21B 10/26* (2006.01)

(52) U.S. Cl. ..... 175/385; 175/406; 175/257

(58) Field of Classification Search ..... 175/344, 175/385, 406, 257, 262
See application file for complete search history.

(56) References Cited

U.S. PATENT DOCUMENTS

| | | | | |
|---|---|---|---|---|
| 1,391,626 | A * | 9/1921 | Gilthorpe | 175/98 |
| 3,190,378 | A * | 6/1965 | Davey, Sr. | 175/257 |
| 3,945,444 | A | 3/1976 | Knudson | |
| 5,284,216 | A * | 2/1994 | Brungs et al. | 175/385 |
| 5,472,057 | A | 12/1995 | Winfree | |
| 5,957,224 | A | 9/1999 | Ilomaki | |

FOREIGN PATENT DOCUMENTS

| | | | |
|---|---|---|---|
| DE | 2155540 | | 5/1973 |
| EP | 1006260 | A2 | 6/2000 |
| WO | WO02/059448 | A1 | 8/2002 |
| WO | WO03/001022 | A1 | 1/2003 |

* cited by examiner

*Primary Examiner*—Jennifer H Gay
*Assistant Examiner*—Robert E Fuller
(74) *Attorney, Agent, or Firm*—Steven Rosenblatt

(57) ABSTRACT

A drilling assembly supports a liner for making a wellbore. The BHA comprises a pilot bit and a reamer above it that is larger in diameter than the suspended liner. If the BHA needs to be pulled out, the reamer is brought into contact with the liner and a latch mechanism between the two engages as another latch that had held the reamer bit to the BHA is released. The reamer bit stays with the liner as the BHA is pulled and later reinserted. On the way in the BHA latches to the reamer bit which then unlatches from the liner bottom. Preferably, splines and a shoulder on the BHA are used to drive the reamer bit as opposed to any power being transmitted through the latch between the BHA and the reamer bit. However, the latch mechanism between the BHA and the reamer bit could also provide torque and weight on bit for drilling operations. The process may be repeated.

18 Claims, 1 Drawing Sheet

LATCHABLE REAMING BIT

PRIORITY INFORMATION

This application claims the benefit of U.S. Provisional Application No. 60/707,654, filed on Aug. 12, 2005.

FIELD OF THE INVENTION

The field of this invention relates to drilling through troublesome zones while advancing a liner and more particularly to techniques for securing a reamer while pulling the bottom hole assembly out for, for example a bit change.

BACKGROUND OF THE INVENTION

In the past bottom hole assemblies (BHAs) have been used that included a pilot bit and a reamer. The drill string to which they were attached extended through a liner so that when a troublesome zone was encountered the liner could be used to isolate it. In the course of drilling, the pilot bit or the reamer could wear out or otherwise require removal from the wellbore; for example, to change the type of bit employed. Pulling the BHA through the liner to change the pilot bit for example would not normally be a problem when using a reamer with extendable arms. This was true as long as the arms retracted when needed so the BHA could be pulled out with the liner supported with slips on the rig floor. However, one problem with the extending arm reamers was that the arms could malfunction and refuse to retract. This would in turn prevent the BHA from coming out through the liner and would require pulling the whole liner out of the hole. This would take a great deal of time and result in extra costs.

Another approach that was tried before was to drive the reamer bit from the BHA with splined surfaces but to support the reamer bit off the bottom of the liner with a bearing. Thus the weight of the reamer bit was carried by the liner while a spline on the BHA transmitted torque to the reamer bit. The idea was that when the pilot bit had to be changed the BHA could simply be pulled through the liner and the splines would release leaving the reamer bit attached at the bottom of the liner. When the pilot bit was renewed, the BHA would be advanced back through the liner and the splines of the BHA would again engage the reamer bit and more hole could be made with weight set on the pilot bit and the liner, possibly with the use of a thruster to maintain even weight on bit. The problem with this design was that the bearing on the lower end of the liner was large and prone to failure before the entire hole was made. If that happened, the liner would have to come out to replace the bearing. This, again, consumed a lot of time and increased costs. An additional limitation was that such a design required that the reamer bit remain near the liner bottom and did not allow for reaming proximate the pilot bit in the event the pilot bit was required to be operated at a distance downhole from the liner bottom.

What is needed and provided by the present invention is a way to temporarily latch the reamer bit to the liner as the BHA is removed so that when the BHA is reinserted it can reliably engage the reamer bit while releasing it from its temporary support position on the liner, and to allow the reamer bit to be latched to the BHA during drilling and/or BHA removal to provide for latching of the reamer bit with the latch profile on the liner bottom. These and other advantages of the present invention will be more readily apparent from a review of the description of the preferred embodiment and the drawing and the claims which appear below.

SUMMARY OF THE INVENTION

A drilling assembly supports a liner for making a wellbore. The BHA comprises a pilot bit and a reamer above it that is larger in diameter than the suspended liner. If the BHA needs to be pulled out, the reamer is brought into contact with the liner and a latch mechanism between the two engages as another latch that had held the reamer bit to the BHA is released. The reamer bit stays with the liner as the BHA is pulled and later reinserted. On the way in the BHA latches to the reamer bit which then unlatches from the liner bottom. Preferably, splines and a shoulder on the BHA are used to drive the reamer bit as opposed to any power being transmitted through the latch between the BHA and the reamer bit. However, the latch mechanism between the BHA and the reamer bit could also provide torque and weight on bit for drilling operations. The process may be repeated.

DETAILED DESCRIPTION OF THE PREFERRED EMBODIMENT

Figure 1:
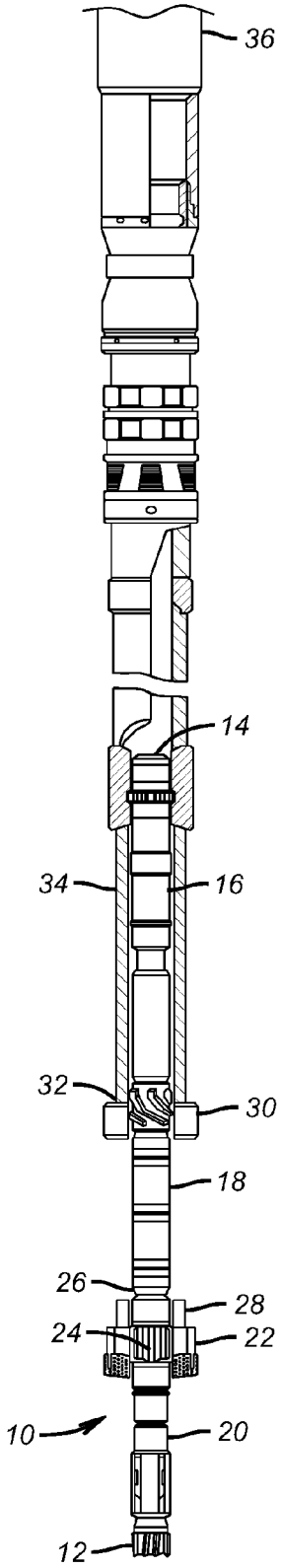
FIG. 1 is an assembly view in schematic form showing the position where drilling can take place.

Referring to FIG. 1 the BHA 10 starts at a lower end with pilot bit 12 and extends to a top end 14. In between are a few known components such as a downhole motor 16 an MWD unit 18 and a steering unit 20 for pilot bit 12. The reamer bit 22 is rotated by the BHA 10 through splines 24. A shoulder 26 on the BHA 10 bears down on the reamer bit 22 when making hole. An internal latch (not shown) keeps the reamer bit 22 from moving down with respect to the BHA as will be explained below. However, the latch may have a lost motion feature so that it is not stressed when making hole in the position shown in FIG. 1.

Figure 2:
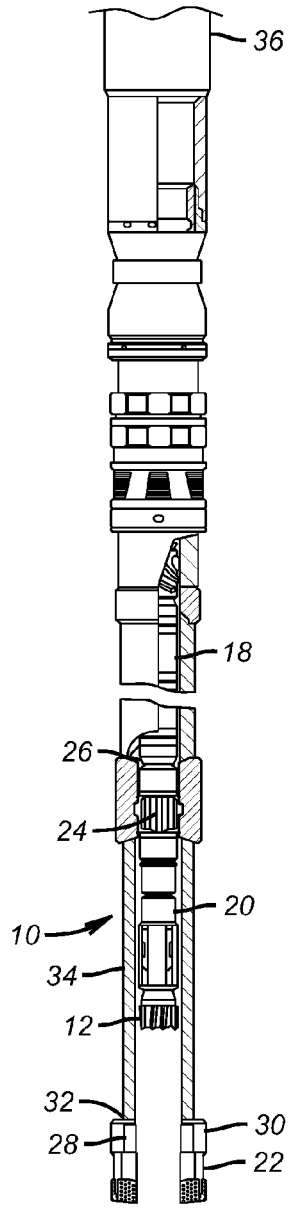
FIG. 2 is the view of FIG. 1 with the reamer engaged to the tubular and the bit coming out with the bottom hole assembly.

The reamer bit 22 has a latch portion 28, which can be either a conventional collet or locking dog configuration or other well-known latching mechanisms that can selectively engage the similar companion latch portion 30 that is located at or near the lower end 32 of liner 34. When the profiles of latch portions 28 and 30 are mated together, the conventional latch (not shown) that holds the reamer bit 22 to the BHA 10 is released to allow the BHA 10 to come out through the liner 34. In a particular embodiment, this may be done by pulling up on the running string 36 until the liner 34 can be held on the rig floor with slips. At that point the top 14 of the BHA 10 is engaged in a known manner raising it with respect to the liner 34. At some point as the BHA 10 is raised, the latch portions 28 and 30 engage and the latch between the BHA 10 and the reamer bit 22 releases at or near the same time so that effective support of the reamer bit can be transferred between the BHA 10 and the liner 34. At that point, as shown in FIG. 2, the BHA 10 can be fully removed through the liner 34 and the bit 12 changed or other maintenance performed and the BHA 10 reassembled and run back into the liner 34 that is still supported by slips at the rig floor. Now running in the latches work in reverse order as when pulling out. The conventional latch that is not shown engages the BHA to the reamer bit 22. As that latch connection is made the reamer bit 22 is released from the liner 34 as latch segments 28 and 30 release. The BHA can be further advanced until the pilot bit 12 reaches the bottom of the hole. On the way to getting the pilot bit 12 to the hole bottom, the reamer bit 22 is retained against falling down the hole off the BHA 10 by the just made internal latch that is not shown. However, when the bottom of the hole is reached by the pilot bit 12 it is preferably the shoulder 26 that bears down on the reamer bit 22 without stressing the unseen latch holding the reamer bit 22 to the BHA 10. In the preferred embodiment, the splines 24 engage a mating spline in the reamer bit 22 for torque transmission, again preferably without stressing the unseen latch. The drilling of the bore can now resume. The process described above can be repeated as often as required.

In an alternative embodiment, the BHA during the drilling operation is simply to unlatch the reamer bit from the BHA and let it sit at the bottom of the hole. The BHA 10 is then pulled out and the pilot bit 12 changed or whatever maintenance that was needed could be performed. In order to resume drilling, the BHA 10 is lowered back in the hole and it gets into alignment with the reamer 22 that was left at the bottom of the hole so that the two could be latched together to make more hole.

In yet another alternative embodiment latching can be provided either between the BHA 10 and the reamer bit 22 or between the reamer bit 22 and the liner 34.

The above description is illustrative of the preferred embodiment and many modifications may be made by those skilled in the art without departing from the invention whose scope is to be determined from the literal and equivalent scope of the claims below.

We claim:

1. A drilling assembly in advance of a tubular in a wellbore, comprising:

a tubular in the wellbore;

a bottom hole assembly comprising a first bit and a reamer extending beyond said tubular;

said reamer when connected to said bottom hole assembly for support of the weight of said reamer is out of contact with said tubular;

said reamer, when brought into contact with said tubular, is adapted to engage said tubular for support of said reamer while releasing from engagement with said bottom hole assembly to allow for removal of said first bit through said tubular; and said reamer adapted to be reconnected to said bottom hole assembly and released from said tubular after being initially released from said bottom hole assembly.

2. The assembly of claim 1, wherein:

said reamer is releasable to drop from said bottom hole assembly.

3. The assembly of claim 1, wherein:

said reamer is latchable at a given time to said bottom hole assembly and at a different time to said tubular.

4. The assembly of claim 3, wherein:

said bottom hole assembly further comprises a rotational drive for said reamer separately located from the location where said bottom hole assembly puts weight on said reamer.

5. The assembly of claim 4, wherein:

said reamer when latched to said bottom hole assembly further allowing some relative movement therebetween;

said relative movement allows said bottom hole assembly to move relatively to said reamer to allow the location that puts weight on said reamer to come in contact with said reamer while said rotational drive remains engaged.

6. The assembly of claim 5, wherein:

said rotational drive comprises mating splines.

7. The assembly of claim 3, wherein:

said bit is removable through said reamer and said tubular when said reamer is supported by said tubular.

8. The assembly of claim 3, wherein:

said reamer when latched to said bottom hole assembly further allowing some relative movement therebetween.

9. The assembly of claim 1, wherein:

said bottom hole assembly supports said tubular for tandem movement with said bit while said bit is advancing.

10. The assembly of claim 1, wherein:

said bit moves with respect to said tubular.

11. A drilling assembly in a wellbore, comprising:

a tubular in the wellbore;

a bottom hole assembly comprising a bit and a reamer, extending beyond said tubular;

said reamer, when downhole is adapted to be releaseably connected to said tubular for support of the weight of said reamer in conjunction with release of support for said reamer from said bottom hole assembly so that said bit can be removed through said tubular.

12. The assembly of claim 11, wherein:

said bottom hole assembly comprises a drive that selectively engages said reamer while releasing said reamer from support by said tubular.

13. The assembly of claim 12, wherein:

said drive comprises splines.

14. The assembly of claim 12, wherein:

said bottom hole assembly further comprises a shoulder that puts weight on said reamer at a separate location from said drive.

15. The assembly of claim 11, wherein:

said bit is removable through said reamer and said tubular when said reamer is connected to said tubular.

16. The assembly of claim 11, wherein:

said bottom hole assembly retains said reamer away from said bit when said reamer is not supported by said tubular.

17. The assembly of claim 11, wherein:

said bottom hole assembly supports said tubular for tandem movement with said bit while said bit is advancing.

18. The assembly of claim 11, wherein:

said bit moves with respect to said tubular.

* * * * *